US006000570A

United States Patent [19]

Nelson

[11] Patent Number: 6,000,570

[45] Date of Patent: Dec. 14, 1999

[54] CONTAINER LID WITH TAMPER EVIDENT SLIP BAND

[76] Inventor: James L. Nelson, 965 N. Fair Oaks Ave., Pasadena, Calif. 91103-3098

[21] Appl. No.: 08/846,460

[22] Filed: May 1, 1997

[51] Int. Cl.[6] ..... B65D 45/30

[52] U.S. Cl. ..... 220/276; 220/320; 215/256; 215/275

[58] Field of Search ..... 220/266, 270, 220/276, 319, 320, 315; 215/254, 250, 253, 274, 273, 256, 275; 222/153.06, 153.07

[56] References Cited

U.S. PATENT DOCUMENTS

| | | | |
|---|---|---|---|
| 1,525,484 | 2/1925 | White | 215/275 |
| 3,642,166 | 2/1972 | Starr | 220/320 |
| 3,905,502 | 9/1975 | Wassilief | 215/250 |
| 4,660,735 | 4/1987 | Peschardt et al. | 220/276 |
| 4,934,554 | 6/1990 | Edwards | 220/276 X |
| 4,934,557 | 6/1990 | Smith | 220/276 |
| 5,069,367 | 12/1991 | Salmon et al. | 222/153.06 |
| 5,115,934 | 5/1992 | Nelson | 220/276 |
| 5,303,835 | 4/1994 | Haber et al. | 215/250 X |
| 5,788,100 | 8/1998 | Sturk | 220/266 X |
| 5,813,554 | 9/1998 | Graziani et al. | 215/274 |

FOREIGN PATENT DOCUMENTS

| | | | |
|---|---|---|---|
| 4017241 | 12/1991 | Germany | 220/320 |

*Primary Examiner*—Stephen K. Cronin
*Assistant Examiner*—Nathan Newhouse
*Attorney, Agent, or Firm*—David O'Reilly

[57] ABSTRACT

An innovative container lid having an integrally formed tamper evident band that goes through a series of changes or metamorphoses during the manufacturing and application process. The tamper evident band is attached to the lid at weak points on dogs formed around the periphery of the lid. Before use, the tamper evident band has a diameter substantially larger than the outer diameter of the lid. When the lid is installed in a container, and tangential and radial forces are applied to the periphery of the lid, the attachment points of the tamper evident band rupture and the band is displaced in a rippling effect with the dogs locking into sockets formed in the sidewall of the tamper evident band. Continued pressure is applied to the side of the tamper evident band until it is pressed firmly around the entire periphery of the lid against the side of a container with all the dogs engaged in sockets. At the final stage, a special breakaway dog engages a socket at the end and the band slips to a new diameter with the end overlapping the beginning to form a pull tab. The lid with the integrally formed tamper evident band is designed to make it easy to handle, stack, feed, decorate, print, box and ship lids while at the same time, providing an effective protection against tampering.

13 Claims, 6 Drawing Sheets

CONTAINER LID WITH TAMPER EVIDENT SLIP BAND

BACKGROUND OF THE INVENTION

1. Field of the Invention

This invention relates to tamper evident containers and more particularly, relates to tamper evident containers that have a tamper evident band or strip around the lid that instantly indicates whether there has been any attempt to tamper with the container.

2. Background Information

In recent years, attempts have been made to prevent product tampering by using seals that indicate evidence of tampering. Some of these methods include sealing the container with a shrink wrap around the lid, while others include providing a tamper evident strip around the lid that will easily fracture, if tampered with, to show evidence of attempts to open the container. These various types of seals and wraps provide immediate evidence of tampering if any attempt is made to open the container and provide a warning to potential users. The tear strips break away from the lid and must be torn off to allow removal of the lid. Any attempt to pry the lid off will result in damage to the tear strip providing evidence of tampering.

Presently available devices concentrate on some way of sealing the lid on containers by adding the shrink wrap or tear strip after the lid is installed on the container. It would be advantageous if the tear strip could be incorporated into the container or lid itself, allowing the use of standard lids.

There are devices available, that are provided on a container, to block access to the lip of the lid and preventing it from being removed without evidence of tampering. These devices involve the use of a collar or flange around the peripheral edge of the lid that block entrance and prevent the lid from being easily removed. A small breakaway portion of the blocking flange must be removed to get a grip on the edge of the lid for removal. A tab on the blocking flange is joined by two thin sections. A downward pressure on the flange causes it to rupture and to breakaway, allowing the person to grip the edge of the lid for removal.

These devices are not entirely effective as the lid can be pried off relatively easily without damaging the barrier arranged by the flange. To solve this problem, tamper resistant tear strips are incorporated into lids around the flange or collar to seal the periphery of the lid. They provide evidence of tampering if anyone attempts to pry off the lid. While the latest tamper evident strips are effective, they are complicated to install onto the container and costly to produce; and have not enjoyed substantial commercial success. For that reason, an improved tamper evident tear strip would be advantageous.

Also, an object of this invention would be to provide a container with a tamper evident strip incorporated or integral with the lid, that solves the problem of strips that have a breakaway portion and leave all, or a substantial portion of the strip on the container. Preferably, the tamper evident strip would be incorporated into the lid and would tear completely away leaving a nearly clean standard container and lid.

One such tamper evident tear strip, incorporated into the lid, is shown and described in U.S. Pat. No. 5,115,934, issued May 26, 1992 to the same inventor as the invention disclosed herein. This device is very effective in preventing tampering of a container. The tear-away strip is comprised of a plurality of tabs joined by integral thin film links that are heat contractible. Thus, this tear strip requires the additional step of heating the periphery of the container as the lid is pressed on.

Another invention that incorporates a tamper resistant tear strip is disclosed and described in U.S. Pat. No. 5,249,694, issued Oct. 4, 1993 to the same inventor as the invention disclosed herein, and incorporated herein by reference. This tamper evident tear strip is constructed to provide evidence of tampering and fits tightly around the rim or skirt of the lid, but has a series of thin rupturable links. The strip may be easily stripped away to allow use of the contents in the container.

It is therefore, one object of the present invention to provide an improved tear-away tamper evident band on a container that seals the periphery of a lid.

Still another object of the present invention is to provide a tamper evident band on a container that when removed, leaves a nearly standard lid on the container to be used.

Still another object of the present invention is to provide a tamper evident tear-away band that slips peripherally as the band is sealed around the periphery of a lid after it is placed on a filled container.

Yet another object of the invention is to provide a tamper evident lid with an improved tear-away band, which reduces unit costs.

Yet another object of the present invention is to provide a new container lid design in which the tamper evident portion of the lid is molded at the same time, and is part of the main lid.

BRIEF DESCRIPTION OF THE INVENTION

The purpose of the present invention is to provide a new container lid design with an improved tamper evident portion, or band on the lid that is molded at the same time, and is part of the main lid.

The basic concept of tamper evident lids is to create a strip or band that surrounds the periphery of the main lid on a plastic container in a manner that incorporates a tamper evident device that must be removed before the main lid can be taken off the cup portion of the container. In most cases, this is being done with a secondary machine, separate shrink bands and different material, all of which increase unit costs. This particular lid design has the tamper evident portion of the lid molded at the same time, and is part of the main lid. The end result is to achieve a lid that creates the tamper evident band or strip on a container of unique design that has substantial economical benefits by reducing unit costs.

The design of the innovative lid for containers provides a series of change or metamorphoses during the manufacture or application process. Each change, caused by the design of this lid, has an advantage at its particular point of manufacture or application.

During molding or full open stage, the unique design of the lid with the integral tamper evident slip band, makes is possible to mold latches, notches and the outer portion of the tamper evident band simultaneously with the lid. Because in the molding process the mold separates in sections, the inner lid can be made similar to a standard lid with undercut grooves that slip over the core of the mold. This design simplifies the difficult areas of the mold for a lid with a tamper evident band because this part of the mold is molded in the open position. This open position, or stage 1 molding, makes it possible to handle, stack, feed, decorate, box and ship lids with an integral tamper evident strip.

Once a container is ready to be filled with product, it is placed in a capping machine such as that disclosed and described in U.S. Pat. No. 5,241,801, issued Sep. 7, 1993 to the same inventor as the inventor disclosed herein, which dispenses individual lids to a locating chute. At this point, a filled cup is placed on the conveying system and the cup is conveyed to the locating chute where a lid drops on the cup. Both are then squeezed between top and bottom conveyer belts. This snaps the lid on the cup while the lid is still in the open or "Stage 1" position.

After the container, with the lid attached, passes under the capping section of the machine, it enters a spin belt section, which begins to squeeze and applies a tangential force while spinning the lid and cup with pressure from opposite sides. The sideways pressures causes the tamper evident tear-away slip band to fracture and break loose from the skirt on the main lid at the segmented gate sections. At this point, the lid is at it's second stage with the outer tamper evident band only attached to the inner lid by a thin section.

As the lid and container continue to spin, the spin belt reaches the thin attached section and starts to press the outer band onto the skirt of the lid. As it spins, the outer band falls in a "ripple" effect toward dogs that match sockets in the tamper evident band causing the band to be accurately positioned and tightly fit the lid. Each dog and matching socket has a small ribbed hook and catch respectively, which prevents downward motion after it is in place. As the lid and band assembly continue to spin pressing locking dogs into sockets, the outer portion of the band (in a ripple effect) "slips" or is displaced to a new dimension or reduced diameter. Due to the fact that the outer tamper evident band was molded at a larger diameter is now wrapping around the smaller diameter of the skirt of the lid, the band becomes longer or increases in circumference length causing it to overlap at the end. This overlap creates a pull tab for removing the tamper evident band.

To lock the band in place at the end, a special double locking dog is made for engagement with the last section. This dog is different from the other dogs because it is made to latch on the band when it is pressed on, but break loose from the main lid when the tamper evident band is pulled off. Once it has broken away or fractured and removed from the main lid, it cannot be pushed back on. An alternative latching system on the last section may be provided by making the last dog larger with stronger hooks. The larger dog with stronger hooks fractures or tears the beginning of the pull tab when it is being removed.

The container is now finished and at its last stage with the tamper evident band tightly secured around the periphery of the lid, leaving a loose pull tab at the end. At this point, the container and lid cannot be opened until the outer band is removed.

Any attempt to gain access to the lid will cause the slip band to rupture, providing evidence of tampering. To remove the lid, the loose tab formed (when the lid is attached) is pulled breaking the locking dogs or in an alternate method, tearing the pull tab, and continued pulling pulls the band loose from the other dogs until it reaches the starting point. The attachment, at that point, is by a weak link that is easily torn lose from the lid. After the tamper evident band is removed, the remaining container and lid function like a standard cup and lid.

The above and other novel features of the invention will be more fully understood from the following detailed description and the accompanying drawings, in which:

DETAILED DESCRIPTION OF THE INVENTION

Figure 1:
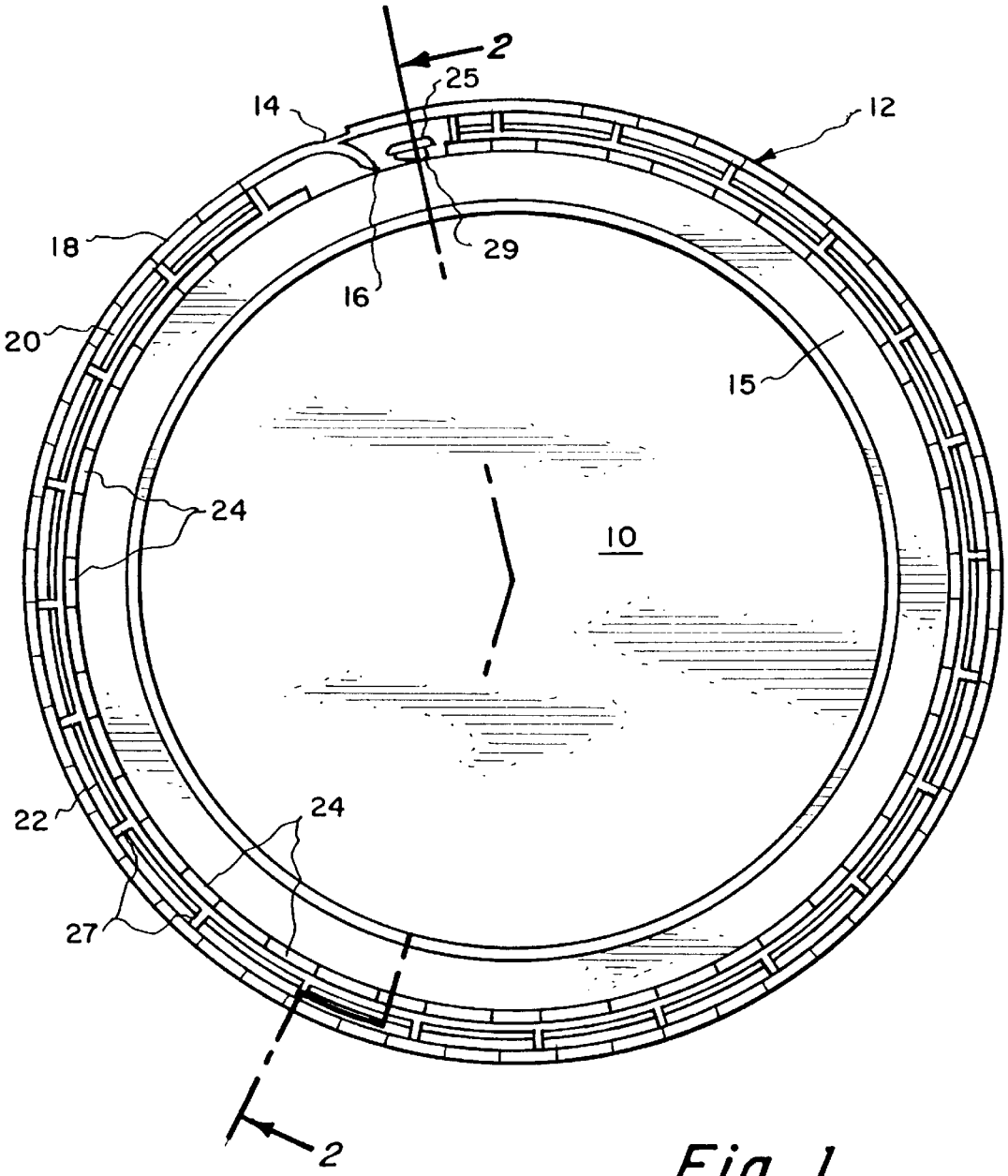
FIG. 1 is a top elevation of a container lid having a tamper evident band constructed according to the invention.

The improved tamper evident lid 10, illustrated in FIG. 1, has an integral tear-away slip band 12 around the periphery that surrounds the peripheral skirt on the outside of the main lid. The invention disclosed in FIG. 1 provides a tamper evident slip band 12, secured to main lid 10 that surrounds the outside of the main lid on a plastic container in such a way that the tamper evident slip band needs to be removed before the main lid can be taken off the cup portion of the container. Lid 10 has a rim 15 forming a skirt and a channel for receiving the peripheral rim on a container as will be described in greater detail hereinafter.

Tamper evident band 12 is integrally formed around the peripheral edge of rim 15 on lid 10. Tamper evident band 12 has a first end 14 attached at thin, weak portion 16 to lid rim 12. Tamper evident band 12 has a vertical sidewall 18 and an angled side 20 adapted to fit against the surface of the container when lid 10 is installed onto container 36.

Figure 2:
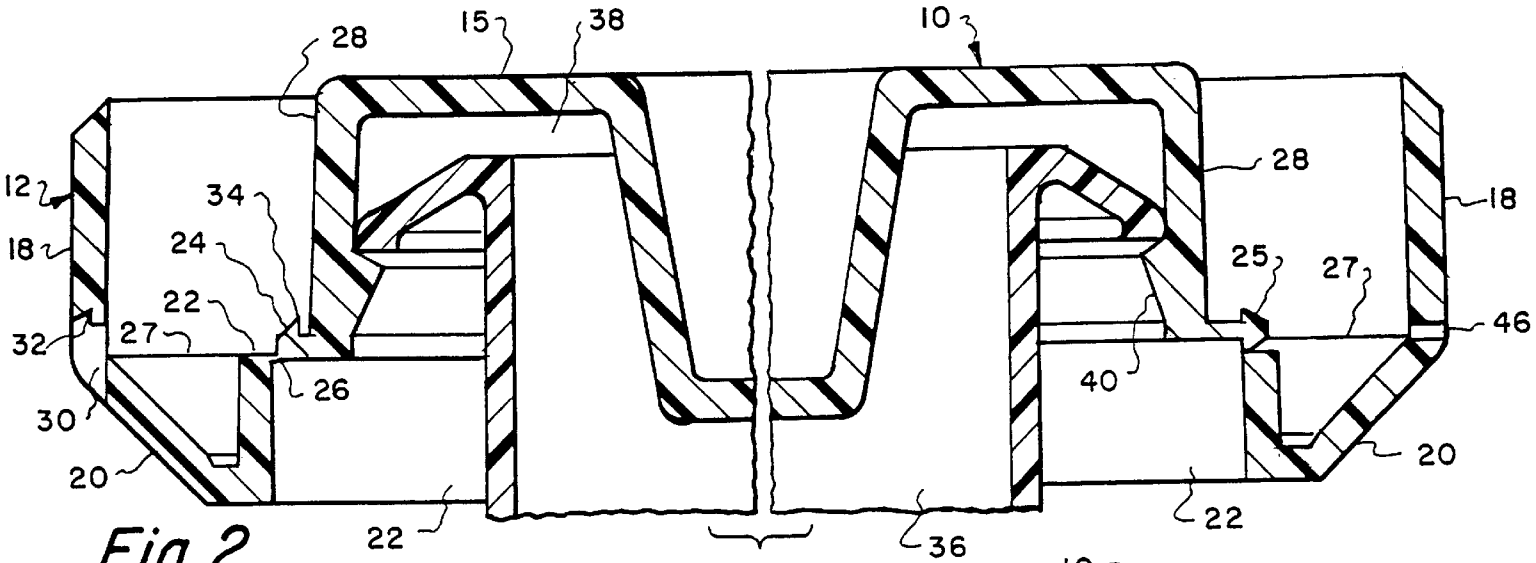
FIG. 2 is a sectional view taken at 2—2 of FIG. 1.
Figure 6:
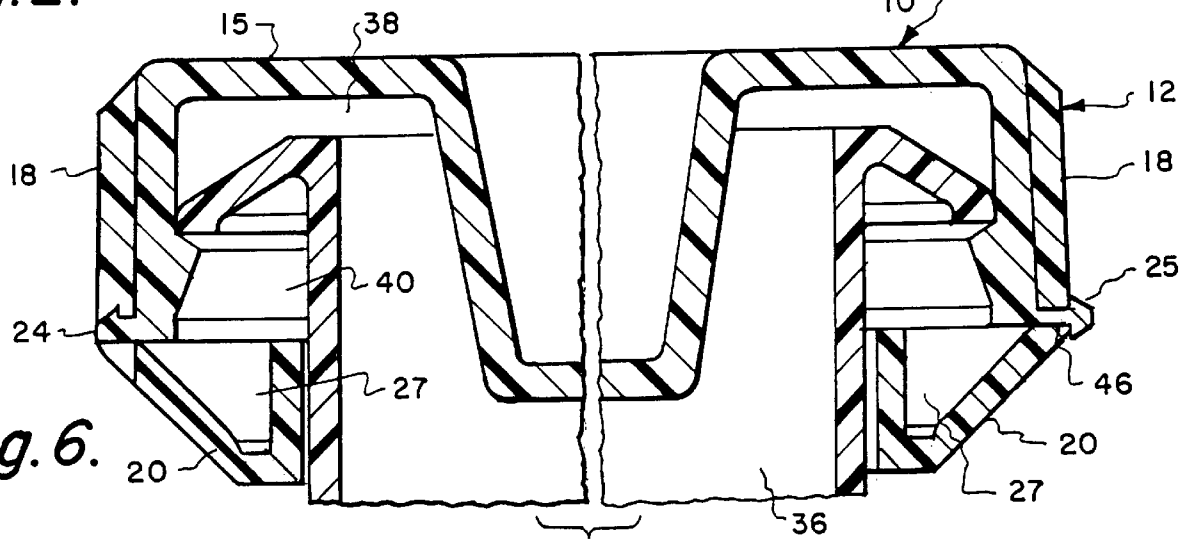
FIG. 6 is a sectional view taken at 6—6 of FIG. 5 illustrating the tamper evident slip band tightly secured around the periphery of the lid.

Peripheral section 22, of tamper evident band 12, is joined to a plurality of dogs or lugs 24 formed around the peripheral edge of lid 10, as can be seen in greater detail in FIG. 2. Tamper evident band 12 is connected by a thin section 26 attaching each dog 24 to stiffening rib 27, spaced around the peripheral skirt 28 on rim 15 of lid 10. A plurality of sockets 30, each having catch 32 for engaging ridge or hook 34, are formed in sidewall 18 of tamper evident band 12.

There are approximately twenty-two equally spaced fixed dogs 24 around the periphery of skirt 28 of lid 10 and an equal number of sockets 30 in sidewall 18 of tamper evident band 12. Each socket 30, for receiving a dog 24, is offset circumferentially for reasons which will be described in greater detail hereinafter.

Also, a specially constructed dog 25 (FIG. 1) is constructed to be held by a thin section 29 so that it will separate from lid 10 when tamper evident band 12 is removed for access to the contents of container 36. Each socket 30, equally spaced around sidewall 18 of tamper evident lid 12, is slightly longer than each dog 34. Further, each socket has a predetermined angular displacement from each dog to allow displacement and engagement with dog 24 as the band ripples around the periphery when being sealed.

The design of innovative lid 10 permits a series of changes or metamorphoses during the manufacture and mounting of the lid on a filled container. Each change provided by the design of lid 10 has an advantage at each particular point in the manufacture or application of the lid to a container.

During molding or full open stage, the unique design of lid 10 makes it possible to mold dogs 24, notches between each dog and the outer portion of sidewall 18 and laterally slanted wall 20 with sockets 30 of tamper evident band 12. Because the mold separates in sections, the inner portion of lid 10 can be made similar to a standard lid with undercut grooves or channels 38 and interior peripheral ridge 40 that can easily slip over the core of the mold. This design simplifies the difficult areas of the mold for tamper evident band 12 and lid 10 because the part is molded in the open position. The distinct advantage of this particular design is, it makes it possible to handle, stack, feed, decorate, print, box and ship lids 10 with integrally formed tamper evident band 12.

Once container 36 is ready to be filled with a product, it is placed in a capping machine such as that disclosed and described in U.S. Pat. No. 5,241,801, issued Sep. 7, 1993 to the same inventor as the invention disclosed herein, which dispenses individual lids to a locating chute above a filled container. At this point, fill container 36 is placed on the conveying system, and is conveyed beneath the chute to receive a lid. Both the lid and container are then squeezed between top and bottom conveyer belts. This snaps lid 10 onto container 36, while the tamper evident band 12 on lid 10 is still in the open or "Stage 1" position.

Figure 3:
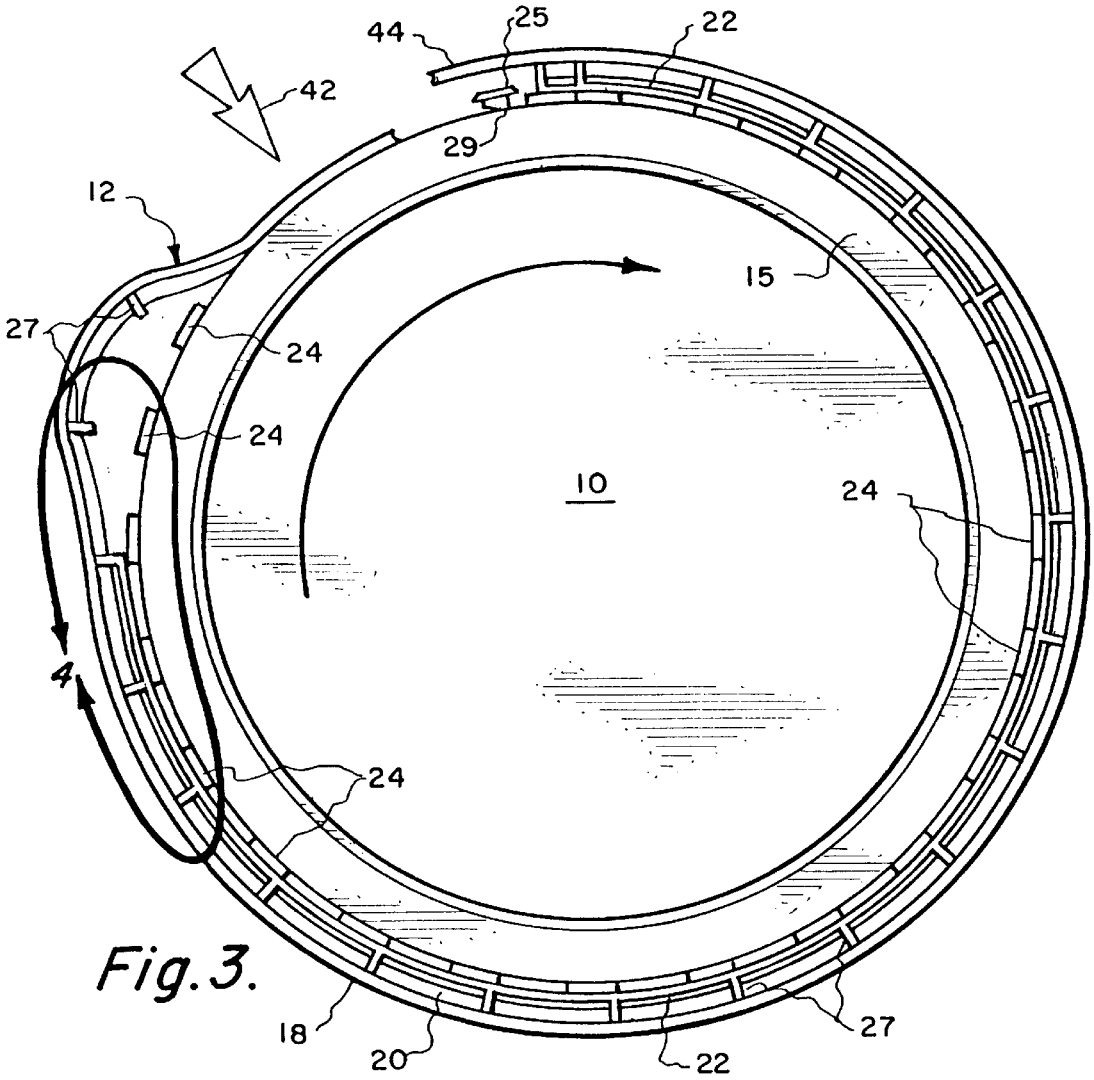
FIG. 3 is a top view of a container lid with a slip band tamper evident strip being installed on a container.
Figure 4:
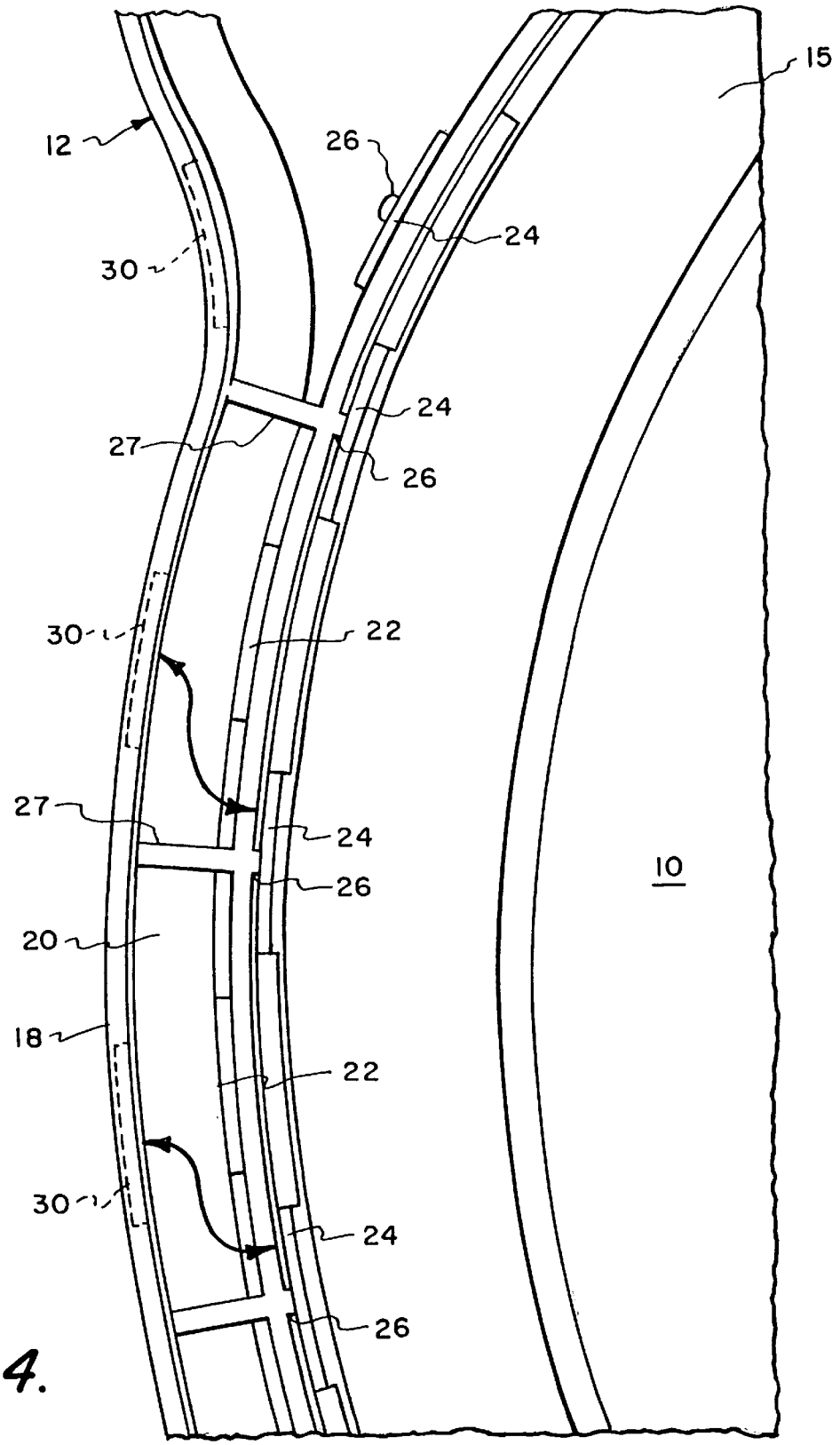
FIG. 4 is a partial section illustrating the "slip" or peripheral displacement (i.e., ripple effect) of the tamper evident band as it is pressed around the periphery of the lid.
Figure 5:
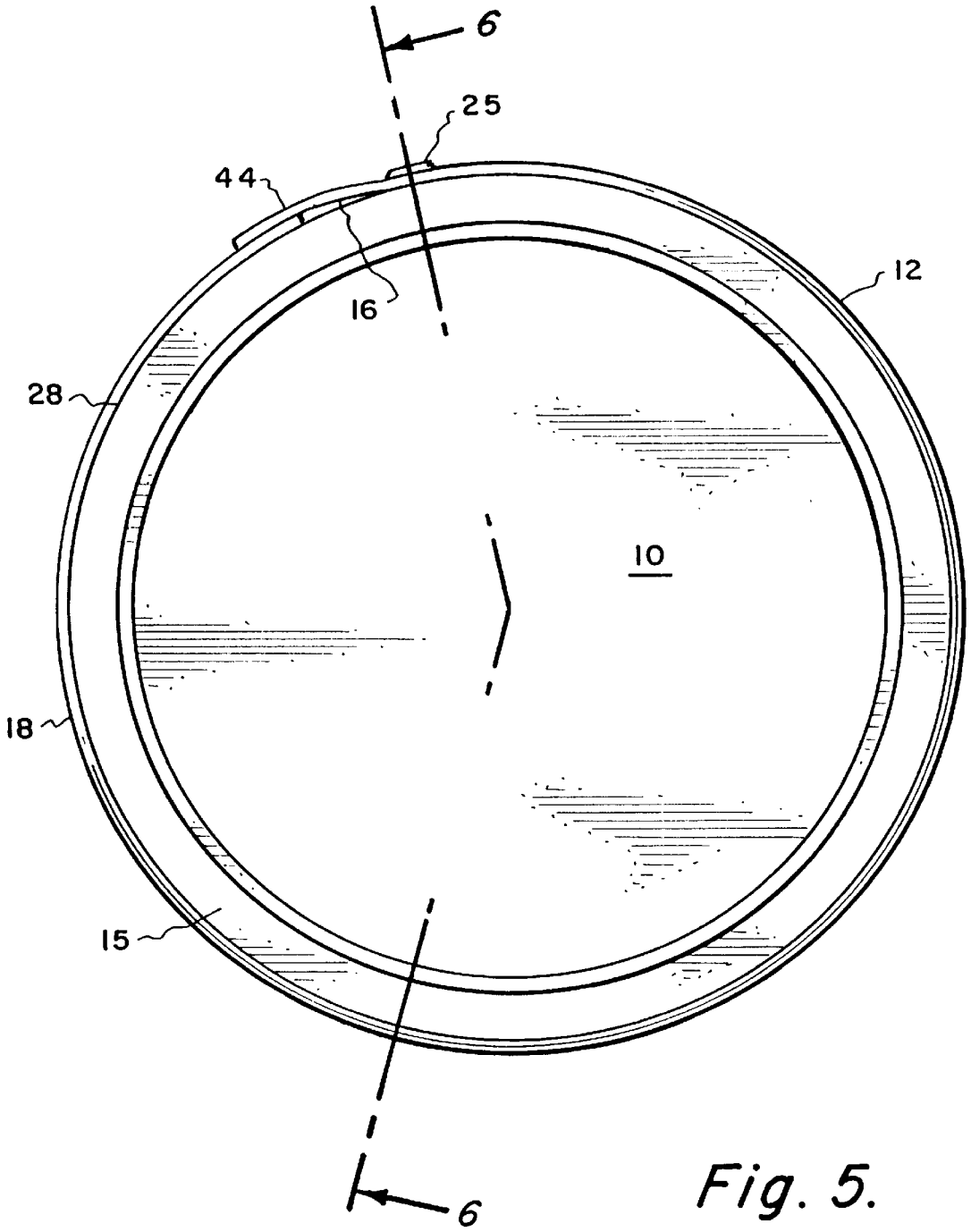
FIG. 5 is a top view of the container lid mounted with the tamper evident slip band tightly secured around the lid.

The method of closing tamper evident band 12, around lid 10, is illustrated in FIGS. 3 and 4. After container 36, with lid attached, passes under the capping section of the machine, it enters a spin belt section which begins to squeeze tamper evident band 12 against skirt 28 of lid 10 as indicated by the arrow. The spin belt section, which is rotating both the container and lid begins to squeeze and spin lid as indicated by the arrow at 42 with pressure from the sides. The sideways pressure causes tamper evident band to fracture at thin connecting points 26 and break loose from lid 10 at each segmented gate section 27. At this point, tamper evident band 12 on lid 10 is at its second stage secured at end 16 to skirt 28 of lid 10. As lid 10 and container 36 continue to spin, the gate sections around the periphery continue to rupture until it reaches attached section 16. The spin belt then starts to press tamper evident band 12 onto lid 10. As it spins, tamper evident band 12 is displaced in a continuing ripple effect onto dogs 24 that match sockets 30 in the band causing it to be positioned tightly around lid 10. Each dog 24 has a small hook or rib 34 engaging catch 32 in matching socket 30, which prevents downward motion after each dog 24 is located in place. As lid 10 and band assembly continue to spin locking successive dogs 24 into sockets 30, the outer portion of tamper evident band 12 or sidewall 18 and angled wall 20 are displaced or "slip" to a new dimension in a ripple effect.

Due to the fact that tamper evident band 12 of lid 10 is larger in diameter than the lid, the circumferential length of tamper evident band increases since it is now wrapping around the smaller diameter of lid 10. Tamper evident band 12 continues to be displaced around the container until the free end overlaps the beginning portion 16, creating pull tab 44. Pull tab 44 is created for use in removing tamper evident band 12 from the container. Specially constructed breakaway dog 25 engages specially constructed socket 46 in sidewall 18 of tamper evident band 12 (FIG. 2).

In order to latch tamper evident band in place at pull tab end 44, specially constructed dog 25 is provided at the last section. Dog 25 is different from the other dogs 24 because it is made to latch pull tab end 44 onto sidewall 18 of tamper evident band 12 when it is pressed on and breaks loose at weakened section 29 when it is pulled off.

The finished container 36, and lid 10 is now at it's last stage with tamper evident band 12, tightly attached around lid 10 leaving loose pull tab 44 at the end. At this point, the lid cannot be opened to gain access to container 36 until tamper evident band 12 is removed.

Figure 7:
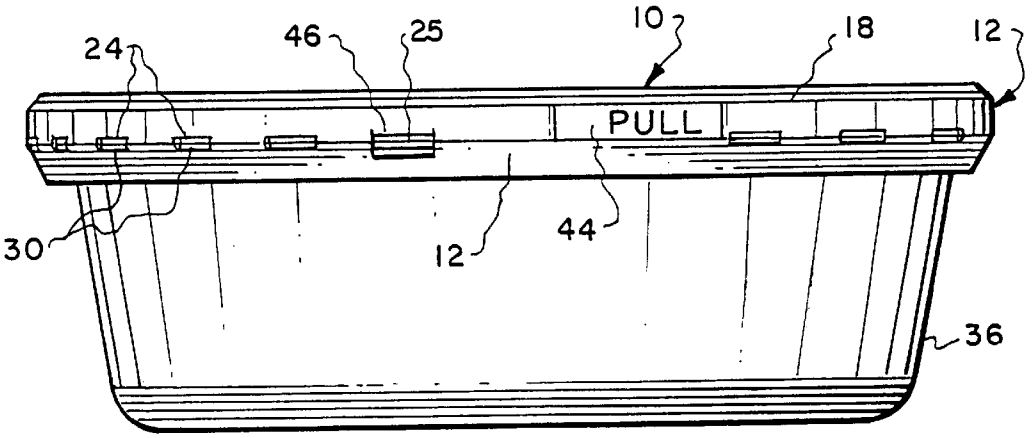
FIG. 7 illustrates a container with the lid sealed by the tamper evident band.
Figure 8:
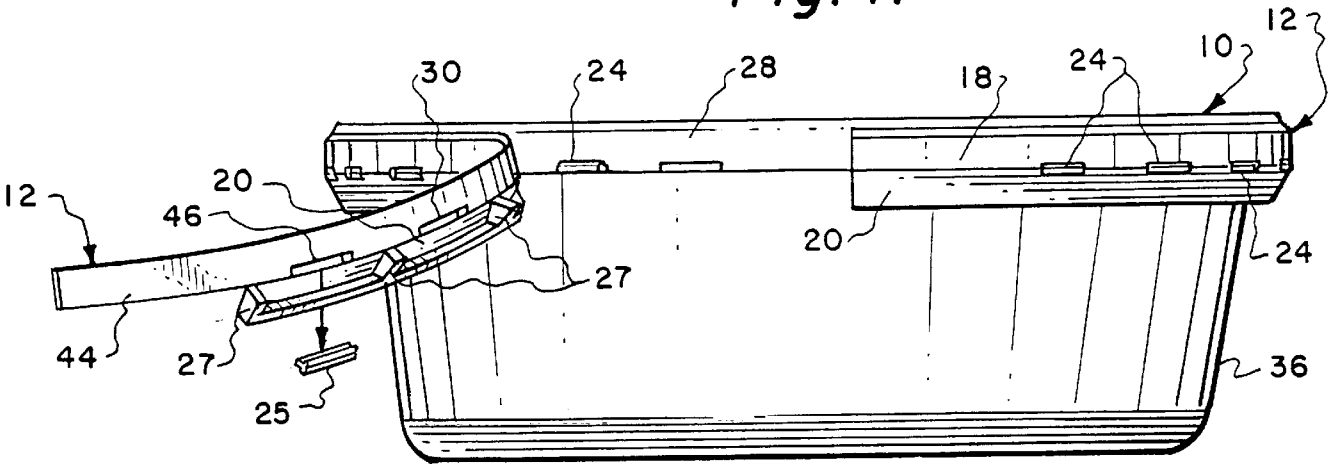
FIG. 8 illustrates removal of the tamper evident band to access the contents of the container.

The tamper evident band securely mounted on a container and its operation is illustrated in FIGS. 7 and 8. Tamper evident band 12 is now securely positioned around the periphery of lid 10 against the side of container 36. With dogs 24 secured in sockets 30 in sidewall 18 of tamper evident band 12. Specially constructed dog 25 is secured in a socket 46.

Tamper evident band 12 is shown in position around the periphery of lid 10 on cup 36 in FIG. 7 and being removed in FIG. 8. When tamper evident band 12 is securely locked on dog 24 and special dog 25, access to container 36 can only be gained by removing tamper evident band 12. Any attempt to pry the lid off will particularly damage the band and special dog 25, which will easily separate and cannot be replaced on the container.

To remove tamper evident band 12, a user grabs pull tab 44 and pulls it away from the container, rupturing the connection of special dog 25 from the sidewall 18 of lid 10. In FIG. 8, special dog 25 is shown separated from tamper evident band 12, but preferably remains attached to the band. Continued pulling force on pull tab 44 strips tamper evident band from around the periphery of the lid. Pulling on the end 44 of the band breaks locking dog 25 and continues to pull loose from the other dogs 24 until it reaches the original starting point 16. The attachment of the band at this point is intentionally weak and can be easily torn lose from the side wall 18 of lid 10. After tamper evident band 12 is removed, the remaining container 36 and lid 10 work in the same manner as a standard cup and lid.

Thus, there has been disclosed a new and improved lid with an integrally formed tamper evident band. The integral tamper evident band has unique and distinct advantages of reduced unit cost and a construction that makes it possible to handle, stack, feed, decorate, box and ship the lids easily. The tamper evident band is constructed to be installed on a lid and filled cup in a rippling effect that causes the band to "slip" to a new diametrical and circumferential dimension with dogs in the lid securely engaged in sockets on the tamper evident band creating a pull tab in the process. A special breakaway dog is provided that cannot be replaced once it is torn away. Optionally, all of the dogs could be constructed to breakaway.

This invention is not to be limited by the embodiment shown in the drawings and described in the description which is given by way of example and not of limitation, but only in accordance a with the scope of the appended claims.

What is claimed is:

1. A tamper evident lid for a container comprising;

a lid having a peripheral flange forming an annulus constructed to fit over a rim on a container;

a tamper evident band formed around and attached to said peripheral flange by a plurality of rupturable sections;

latch means for latching said tamper evident band securely around the periphery of said lid when installed on a container;

latch receiving means around the periphery of said lid for receiving said latch means;

said tamper evident band being constructed for radial displacement by application of a tangential force from a first diametrical position to a second diametrical position with respect to said lid to cause said latch means to engage said latch receiving means;

whereby when said tamper evident band is pressed around said periphery of said lid mounted on said container and secured by said latch means to securely lock said lid to said container, said tamper evident band has an overlapping end forming a pull tab.

2. The lid according to claim 1 in which said tamper evident band comprises: a sidewall constructed to fit against said peripheral flange and an oblique wall constructed to fit beneath said annulus and against the side of a container when said lid is installed.

3. The lid according to claim 1 in which said latch means comprises a plurality of dogs formed on the peripheral flange of said lid and a plurality of matching sockets in said tamper evident band.

4. The tamper evident lid according to claim 3 in which one of said dogs is constructed to be removable with said tamper evident tear strip.

5. The tamper evident container according to claim 4 in which each of said plurality of locking dogs are peripheral, equally spaced sections on said lid peripheral flange having a locking ridge adapted to pass through said sockets on said tamper evident tear strip tightly locking said tamper evident tear strip on said lid.

6. The lid according to claim 3 in which said plurality of rupturable sections are formed at said plurality of dogs.

7. The lid according to claim 6 in which said plurality of rupturable sections comprise a plurality of radial extending ribs on said tamper evident band and a thin rupturable web attaching said radially extending ribs to said peripheral flange of said lid.

8. The lid according to claim 6 including a special dog having a weakened link to said peripheral flange on said lid for separating said dog from said lid when said tamper evident band is removed.

9. The lid according to claim 8 in which said special dog is an last dog at the end of said tamper evident band.

10. The lid according to claim 9 in which there are approximately twenty-two dogs formed around the peripheral flange of said lid.

11. A tamper evident container comprising;

a container having an open end;

a lid having a peripheral flange forming an annulus for fitting over a peripheral rim around said open end of said container;

a tamper evident tear strip formed and secured to said peripheral flange by a plurality of fracturable sections;

a plurality of locking dogs formed around an edge of said peripheral flange of said lid;

a plurality of sockets formed in said tamper evident tear strip;

said tamper evident tear strip having a diameter constructed for displacement by a tangential force against said tamper evident tear strip around the perimeter of said lid to displace said tamper evident tear strip from a first diametrical position to a second diametrical position tightly fitting around the periphery of said lid with said plurality of dogs engaging said plurality of sockets, an end of said tamper evident tear strip overlapping a beginning end of said tamper evident tear strip to form a pull tab;

whereby said tamper evident slip band tightly secures said lid on said container to prevent removal of said lid without evidence of tampering.

12. The tamper evident container according to claim 11 in which one of said dogs is a locking dog constructed to be removable with said tamper evident tear strip.

13. The tamper evident container according to claim 12 in which each of said plurality of locking dogs are peripheral, equally spaced sections formed on said lid peripheral flange having a locking ridge adapted to pass through said sockets on said tamper evident tear strip tightly locking said tamper evident tear strip on said lid.

* * * * *